United States Patent [19]

Dilny

[11] Patent Number: 4,676,508

[45] Date of Patent: Jun. 30, 1987

[54] METHOD AND MEANS FOR DETERMINING GOLF BALL IMPACT

[76] Inventor: Mike M. Dilny, 3900 W. Dundee Rd., Northbrook, Ill. 60062

[21] Appl. No.: 829,509

[22] Filed: Feb. 14, 1986

[51] Int. Cl.[4] ..... A63B 69/36

[52] U.S. Cl. ..... 273/186 D; 273/235 R; 273/167 J; 273/173

[58] Field of Search ..... 273/186 D, 235 R, 167 J, 273/173, 169, 170, 171, 172, 174, 175, 168

[56] References Cited

U.S. PATENT DOCUMENTS 3,169,771 2/1965 Holmes ..... 273/186 D
3,647,221 3/1972 Holley ..... 273/235 A

FOREIGN PATENT DOCUMENTS 12046 1/1977 Japan ..... 273/186 D

*Primary Examiner*—George J. Mario
*Attorney, Agent, or Firm*—Wood, Dalton, Phillips, Mason & Rowe

[57] ABSTRACT

A method and apparatus for determining the point of impact of a golf club head on a golf ball such as one having an outer coating of polyurethane resin containing aluminosilicate and titanium dioxide, such as for use in improving a golfer's swing. A golf club head is provided having an impact surface on which an indication of the impact of the head against the ball is retained subsequent to the impact. In the disclosed embodiment, the impact surface portion is formed of fiberglass fibers, carbon fibers, and a binder. The indication is erasable as by the golfer wiping his finger across the thusly marked impact surface. A golf club head composition and golf ball coating cooperatively providing the desired impact indication are disclosed.

12 Claims, 6 Drawing Figures

METHOD AND MEANS FOR DETERMINING GOLF BALL IMPACT

TECHNICAL FIELD

This invention relates to method and apparatus for determining the point of impact on a golf club head, such as for improving the swing of a golfer.

BACKGROUND ART

Many devices have been developed in an effort to improve a golfer's swing and ball contact. Such devices have been relatively expensive, complicated, or have failed to properly provide the desired information and assistance.

DISCLOSURE OF INVENTION

The present invention comprehends an improved method and means for determining the point of impact of a golf club head on golf ball, which is extremely simple and economical and which provides the desired information to the golfer in a novel and simple manner.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
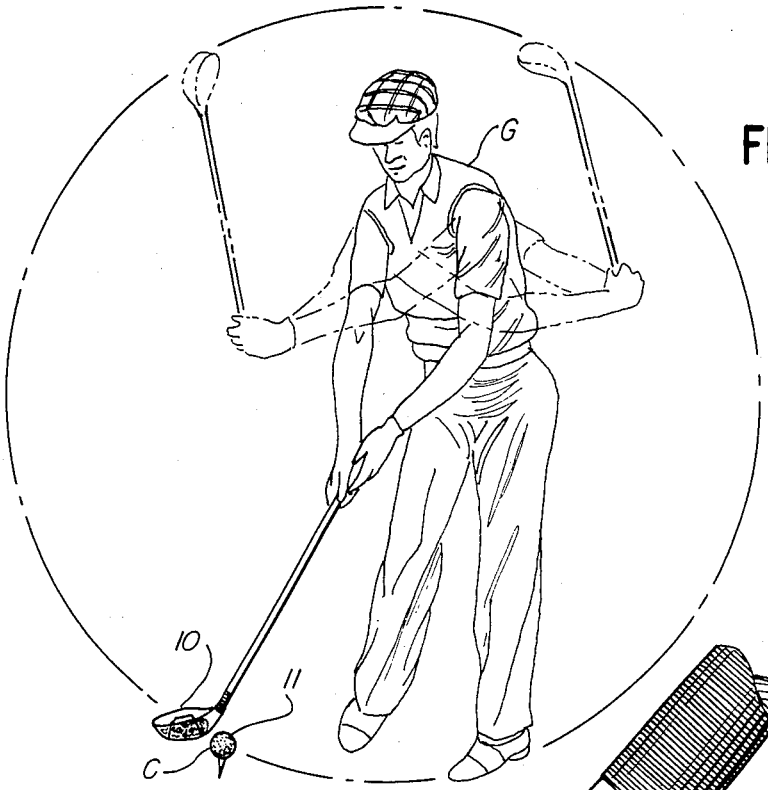
FIG. 1 is a perspective view of a golfer utilizing the invention.

In the illustrative embodiment of the invention as disclosed in the drawing, an improved means for determining the point of impact of a golf club head generally designated 10 on a golf ball generally designated 11 is disclosed for use in improving the swing of a golfer G. By providing an indication of the impact of the club head against the ball, the golfer may determine the cause of undesirable ball flight, etc.

The invention comprehends the provision of such means for indicating the impact of the club head on the ball which is readily erasable, whereby a series of successive determinations may be readily effected.

More specifically, the invention comprehends the provision of the golf club head as comprising a graphite-type defining an impact surface 12 which may include the surface 13 of an insert 14 and the surface 15 of the head 10 in which the insert is mounted as by conventional brass screws 16.

In the illustrated embodiment, the head 10 comprises a composite of glass fibers, carbon fiber, and a suitable binder.

It is conventional to provide such carbon fiber composite golf club heads with an outer coating 17 of a varnish or synthetic resin. The invention comprehends the omission of the protective coating 17 on the impact surfaces 14 and 15.

Figure 6:
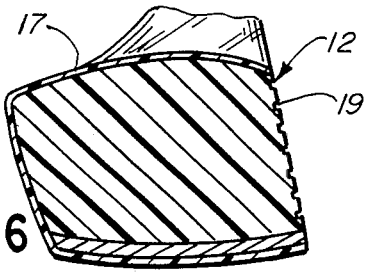
FIG. 6 is a fragmentary vertical section taken substantially along the line 6—6 of FIG. 5.
Figure 5:
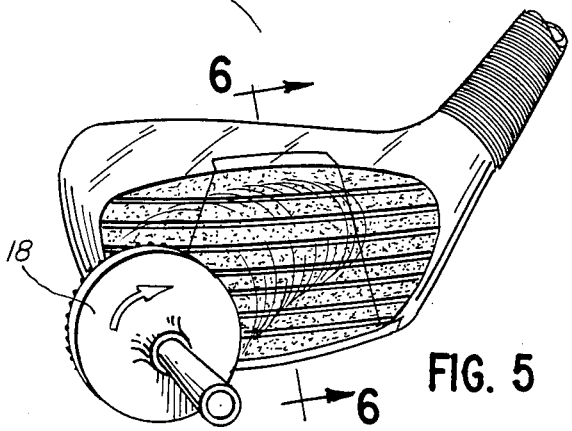
FIG. 5 is a perspective view illustrating a step in treating the face of the conventional graphite club head for practicing the invention.

Thus, where the club head is originally provided with a coating on the impact surfaces, the coating is preferably removed as by a sander 18 of conventional construction from both the impact surface 13 and impact surface 15. As illustrated in FIG. 6, the impact surface 12 defined by surfaces 13 and 15 retains the horizontal grooves 19 of the club head in providing the desired control afforded thereby.

The golf ball 11 preferably, in carrying out the invention, is provided with an outer coating C adapted to transfer a portion of the material to the impact surface as a result of the impacting of the club head thereagainst in the carrying out of a golf swing by the golfer G. In the illustrated embodiment, the coating is formed of a polyurethane resin containing aluminosilicate and titanium dioxide, which has been found to provide an excellent erasable indication of the impact of the head surface 12 against the ball.

As indicated above, the impact surface may comprise a machined surface which is free of the protective coating. As will be obvious to those skilled in the art, the surface may be provided in the club head as originally provided by the manufacturer by omitting the protective coating from the surface 12.

In the illustrated embodiment, the aluminosilicate of the ball coating comprises flyash.

In the illustrated embodiment, the carbon fibers of the head and insert have an aspect ratio which is less than that of conventional graphite fibers. The insert is formed of a material generally similar to that of the head. In the illustrated embodiment, the insert is formed of material having glass fibers which differ from those of the head.

In the illustrated embodiment, the binder of the head and insert includes sulfur and chlorine.

Figure 3:
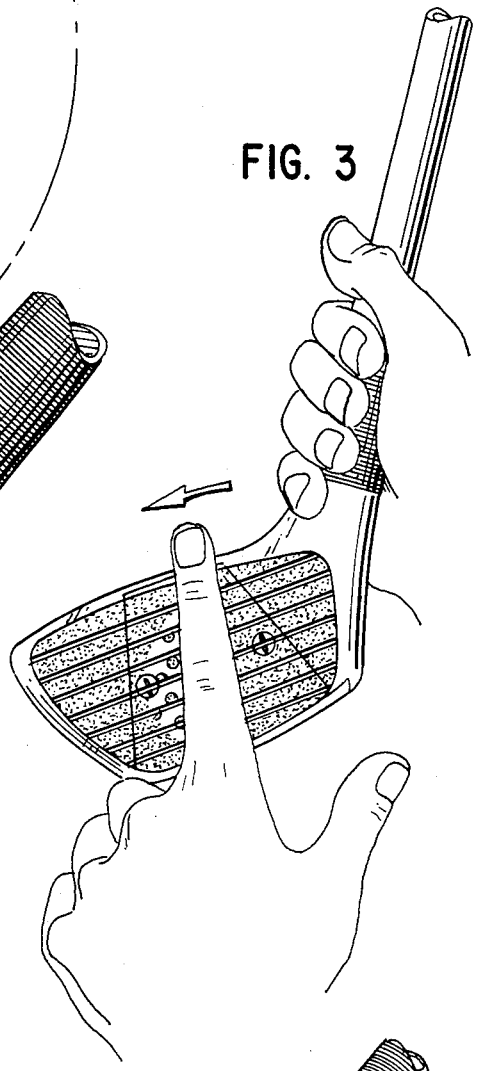
FIG. 3 is a fragmentary elevation illustrating the method of removing the impact indication from the base of the golf club head in practicing the invention.
Figure 4:
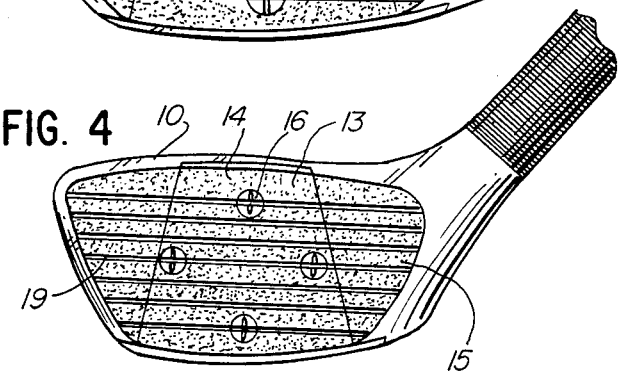
FIG. 4 is a fragmentary elevation of a conventional graphite-type golf club head.

As illustrated in FIG. 3, the invention comprehends the provision of the impact surface and ball coating characteristics permitting ready erasing of the impact indication. As shown in FIG. 3, the erasing may be readily effected in practicing the invention by the user G wiping a finger across the surface of the club head. It has been found that such erasure effectively eliminates the previous impact indication and restores the club head impact surface for a subsequent indication.

Figure 2:
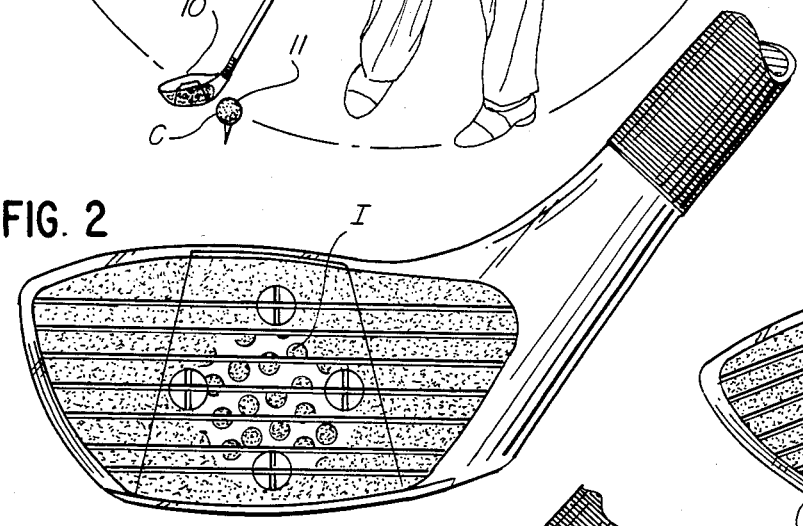
FIG. 2 is a fragmentary enlarged elevation of a golf club head illustrating the impact illustration provided thereon subsequent to the impacting of the club head against a golf ball.

The impact indication is illustrated at I in FIG. 2, and as shown, comprises a planar showing of the dimple surface of the ball wherein a portion of the coating material is deposited on the impact fact 12.

It appears that the improved impact indication is a result of the use of the uncoated impact surface of the club head, with the indicated form of ball coating.

The invention provides an extremely useful tool for a golfer in determining the correctness of his swing and does so in an extremely simple and economical manner. Where no impact indication is desired by the golfer, the tool may be utilized in the normal manner. However, if the impact face of the club is wiped off after each use, the invention provides an impact indication to the user which may be of substantial value each time the flight of the ball is not as desired by the user.

The present invention is advantageous in that the club and ball may be utilized in the conventional manner without use thereof in providing indications of the respective impacts in such use. At any time, however, the user wishes to utilize the club and ball in accordance with the invention to determine the point of impact in a subsequent stroke, the user need merely wipe the impact surface to prepare it for the desired indication of the impact on the next stroke.

In broad aspect, the invention comprehends the method of determining the point of impact of a golf club head on a golf ball by causing a readily discernible marking on the impact surface of the club head as a result of the impacting thereof on the ball in carrying out a golf stroke. The invention further broadly comprehends the concept of providing means for producing such an indication which permits ready erasing of the indication on the impact surface to permit a subsequent indication on the next stroke.

The foregoing disclosure of specific embodiments is illustrative of the broad inventive concepts comprehended by the invention.

I claim:

1. The method of determining the point of impact of a golf club head on a golf ball, comprising the steps of:

providing a golf club having a head formed of fiberglass fibers, carbon fibers, and a binder, and defining an impact surface; and impacting the club head against a golf ball having a dry, substantially permanent outer coating of polyurethane resin containing aluminosilicate and titanium dioxide to cause a readily removable deposit of the ball coating on said impact surface at the point of impact thereof on the ball, said readily removable deposit being erasable as by being wiped, said club head and ball being constructed to be used in the manner of conventional golf play.

2. The method of determining the point of impact of a golf club head on a golf ball of claim 1 including the step of wiping said impact surface free of any previously deposited coating resulting from a previous impacting thereof.

3. The method of determining the point of impact of a golf club head on a golf ball of claim 1 including the further step of wiping said deposit from said impact surface subsequent to use thereof in determining the point of impact.

4. The method of determining the point of impact of a golf club head on a golf ball of claim 1 including the further step of wiping said deposit from said impact surface with the user's finger subsequent to use thereof in determining the point of impact.

5. The method of determining the point of impact of a golf club head on a golf ball of claim 1 including the further step of removing protective coating material from said impact surface prior to initial use thereof in carrying out said method.

6. Means for determining the point of impact of a golf club head on a golf ball, comprising:

a golf club having a head comprising fiberglass fibers, carbon fibers, and a binder, and defining an impact surface; and a golf ball having a dry, substantially permanent outer coating of polyurethane resin containing aluminosilicate and titanium dioxide to cause a wipably removable deposit of the ball coating on said impact surface at the point of impact thereof on the ball, said readily removable deposit being erasable as by being wiped, said club head and ball being constructed to be used in the manner of conventional golf play.

7. The means of claim 6 wherein said impact surface comprises a machine surface free of protective coating.

8. The means of claim 6 wherein said ball coating aluminosilicate comprises flyash.

9. The means of claim 6 wherein said carbon fibers have an aspect ratio less than that of conventional graphite fibers.

10. The means of claim 6 wherein said club head is provided with an insert defining a portion of said impact surface.

11. The means of claim 6 wherein said club head is provided with an insert defining a portion of said impact surface, said club head including fiberglass fibers different from those of said insert.

12. The means of claim 6 wherein said binder includes sulfur and chlorine.

* * * * *